US005458242A

United States Patent [19]

Baka et al.

[11] Patent Number: 5,458,242

[45] Date of Patent: Oct. 17, 1995

[54] COLLAPSIBLE LITERATURE HOLDER

[75] Inventors: Peter Baka, Parma; Daniel J. Kump, Mentor; Christopher M. Paterson, Willoughby, all of Ohio

[73] Assignee: Fasteners For Retail, Inc., Cleveland, Ohio

[21] Appl. No.: 278,404

[22] Filed: Jul. 21, 1994

[51] Int. Cl.[6] ..... A47F 5/11; B65D 85/62

[52] U.S. Cl. ..... 206/488; 206/486; 211/50; 248/174

[58] Field of Search ..... 206/45.14, 45.25, 206/45.26, 424, 449, 425, 486, 488; 211/73, 50, 132; 248/174, 459, 472

[56] References Cited

U.S. PATENT DOCUMENTS

| | | | |
|---|---|---|---|
| Re. 18,153 | 8/1931 | Horwath . | |
| 1,543,102 | 6/1925 | Fleischer | 248/174 |
| 1,699,875 | 1/1929 | Burgess . | |
| 1,713,758 | 5/1929 | Horwath . | |
| 1,718,319 | 6/1929 | Towell . | |
| 1,896,677 | 2/1933 | Myers . | |
| 2,003,244 | 5/1935 | Carboni | 211/73 |
| 2,097,553 | 11/1937 | Gruenberg | 248/174 |
| 2,105,594 | 1/1938 | Henrich . | |
| 2,110,429 | 3/1938 | Sunderhauf . | |
| 2,168,063 | 8/1939 | Everson . | |
| 2,726,835 | 12/1955 | Hummel . | |
| 3,013,668 | 12/1961 | Mennen | 211/73 |
| 3,586,279 | 6/1971 | Benson . | |
| 4,130,197 | 12/1978 | Fox . | |
| 4,424,906 | 1/1984 | Richmond . | |
| 4,817,905 | 4/1989 | Rondone | 248/174 |
| 4,925,031 | 5/1990 | Collins . | |
| 4,965,946 | 10/1990 | Hegedus et al. . | |

FOREIGN PATENT DOCUMENTS

| | | | |
|---|---|---|---|
| 459175 | 8/1949 | Canada | 248/459 |

*Primary Examiner*—Jimmy G. Foster

*Attorney, Agent, or Firm*—Fay, Sharpe, Beall, Fagan, Minnich & McKee

[57] ABSTRACT

A literature holder is formed of an elongated sheet having spaced first and second transverse score lines. The sheet is bent along the first score line to form a front panel and a back panel, which extends in a first direction from the front panel, and bent along the second score line to form a bottom panel, which extends in a second direction from the front panel. A substantially U-shaped flap is formed in the front panel such that the two ends of the U contact the first score line. A tab extents from the bottom panel. A layer of adhesive is provided on the tab so that when the adhesive layer is contacted with the back panel to secure the tab to the back panel, the sheet can be formed into a triangular shape in which the holder is in a use configuration. Then the U-shaped flap can be bent out of the plane of the front panel and back towards the rear panel to accommodate goods, such as pamphlets, in the holder for display and dispensing. The holder can also be folded flat for storage or shipment.

22 Claims, 4 Drawing Sheets

COLLAPSIBLE LITERATURE HOLDER

BACKGROUND OF THE INVENTION

This invention relates to a holder for goods. More specifically, the present invention relates to a holder formed from a single cut and scored blank of sheet material.

While the holder is particularly used for, and will hereinafter be described in connection with the display and dispensing of literature such as, e.g., credit card application forms and the like, the holder could also be employed to display and dispense a variety of other items. Preferably, the holder according to the present invention is made from a cardboard material so as to be inexpensive both to manufacture and to print on. Such a holder is advantageous because it is recyclable since it is made out of paper stock. However, it should be appreciated that the holder could be made out of a variety of other types of materials such as conventional thermoplastic materials or the like.

A variety of literature holders is known. Most of these holders, however, are formed of thermoplastic materials and for that reason are not easily recyclable. Moreover, such thermoplastic literature holders are relatively expensive to manufacture and difficult to print on due to their plastic nature. A number of the known holders are also not formed of a single sheet of planar material as would be advantageous in order to reduce costs. In addition, many such holders are not collapsible for easy transport and storage.

Holders for goods made of a single sheet of cardboard are known. Many of these can also be collapsed. However, those holders which can be collapsed are usually not very stable in their display position. In addition, the known cardboard holders suffer from a complicated construction which is difficult both to manufacture and to assemble.

Accordingly, it has been considered desirable to develop a new and improved holder for goods which would overcome the foregoing difficulties and others while providing better and more advantageous overall results.

SUMMARY OF THE INVENTION

According to the present invention, a holder for goods is provided.

More particularly in accordance with this aspect of the invention, the holder comprises an elongated sheet having first and second transverse score lines, the sheet being bent along the first score line to form a front panel and a back panel, extending in a first direction from the front panel, and bent along the second score line to form a bottom panel, extending in a second direction from the front panel. A substantially U-shaped flap is formed in the front panel such that the two ends of U contact the first score line. A tab extends from a bottom panel. A layer of adhesive is provided on the tab wherein when the adhesive layer is contacted with the back panel to secure the tab to the back panel, the sheet can be formed into a triangular shape in which the holder is in a use configuration.

Preferably, the holder can be collapsed into a flat non-use configuration along a third score line. The third score line extends transversely across the bottom panel parallel to the second score line and is spaced therefrom such that the bottom panel can be folded along the third score line into first and second sections. Preferably the flap can be folded out of the front panel and towards the back panel to allow goods to be inserted into the holder for display and dispensing.

Preferably, the holder further comprises fourth and fifth score lines, each located in the bottom panel and extending at an acute angle to the first and second side edges of the bottom panel. The bottom panel can be folded along the fourth and fifth score lines to form first and second side braces for the holder when the holder is in its use configuration. The fourth and fifth score lines preferably intersect the third score line.

According to another aspect of the present invention, a holder for goods is provided.

More particularly in accordance with this aspect of the invention, the holder comprises an elongated sheet having first and second transverse score lines, the sheet being bent along the first score line to form a front panel and a back panel, extending in a first direction from the front panel, and bent along the second score line to form a bottom panel, extending in the second direction from the front panel. A flap is formed in the front panel for accommodating goods held in the holder when the flap is bent out of the front panel. A tab extends from one of the back panel and the bottom panel and cooperates with the other of the back panel and the bottom panel to form the holder into a triangular shape in which the holder is in a use configuration. First and second side braces are formed in the bottom panel and delineated respectively along third and fourth score lines. The side braces support the holder in its use configuration.

One advantage of the present invention is the provision of a new and improved holder for goods.

Another advantage of the present invention is the provision of a holder which can be stored and shipped in a collapsed planar configuration and selectively folded into a use configuration in which it is substantially triangular in shape.

Still another advantage of the present invention is the provision of a holder for goods which is made of a sheet of planar material so that it can be manufactured in an inexpensive manner by being, e.g. die cut from the material. The holder is preferably comprised of a substantially rectangular sheet of material provided with a series of score lines. This construction allows the holder to be readily folded up into its use configuration.

Yet another advantage of the present invention is the provision of a holder for goods which is made out of conventional cardboard stock or the like so that it is inexpensive to manufacture, can be readily printed on and is recyclable.

A further advantage of the present invention is the provision of a holder for goods which has a pair of side support braces which can be folded up from the bottom panel of the holder in order to support the holder in its use configuration.

A still further advantage of the present invention is the provision of a holder for goods which has a pair of side support braces that cooperate with a flap which can be folded out of a front panel of the holder in order to correctly orient the goods meant to be held in the holder.

A yet further advantage of the present invention is the provision of a holder for goods which includes a front panel, a rear panel and a bottom panel wherein one of the rear panel and the bottom panel includes a tab which cooperates with the other of the rear panel and the bottom panel in order to form the holder into a triangular shape when the holder is in a use configuration.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts a preferred embodiment of which will be described in detail in this specification and illustrated in the accompanying drawings which form a part hereof and wherein.

DETAILED DESCRIPTION OF THE PREFERRED EMBODIMENT

Figure 1:
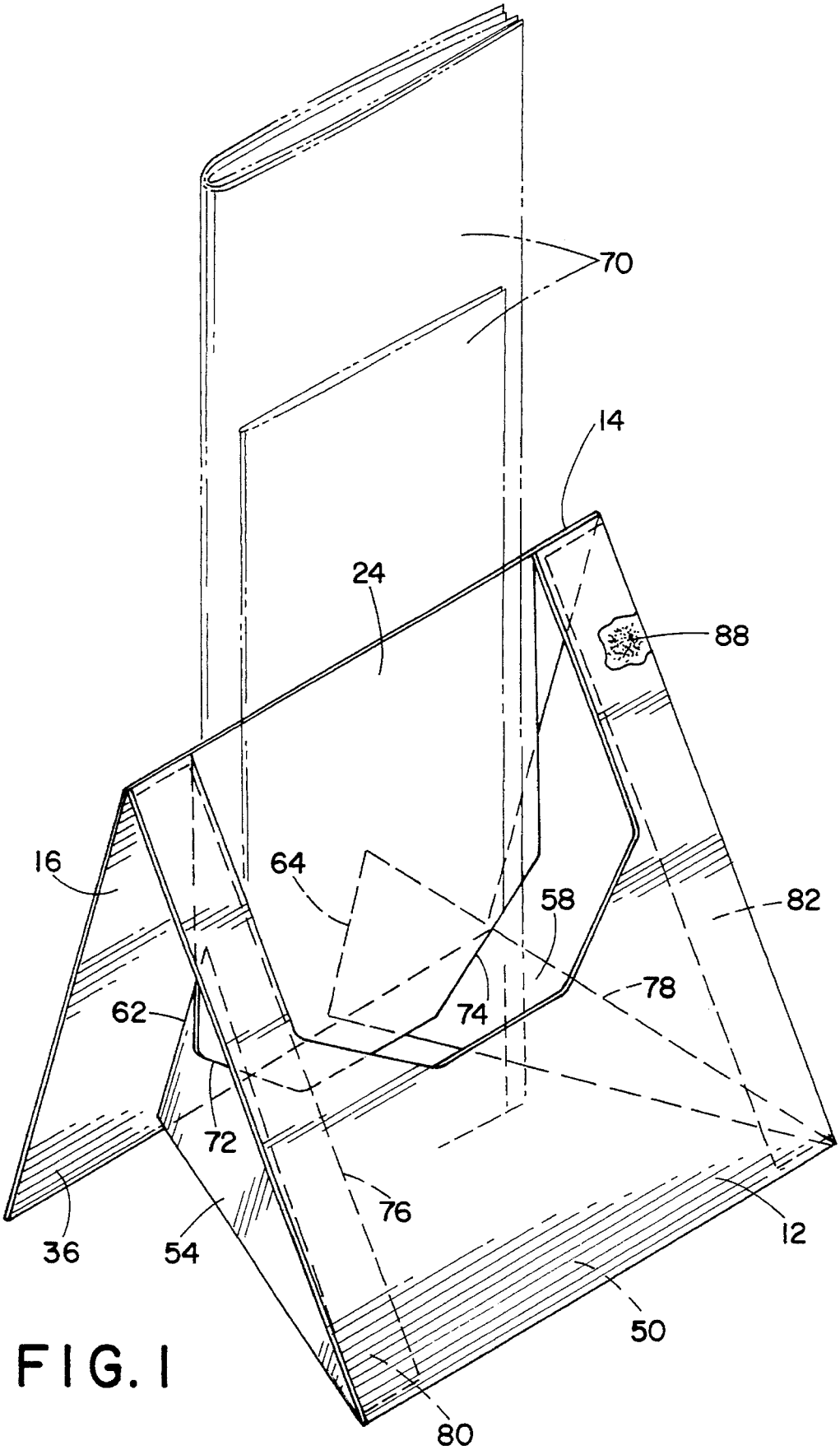
FIG. 1 is a perspective view of a holder for goods according to the present invention with the holder being shown in a triangular use configuration.

Referring now to the drawings which are for purposes of illustrating the preferred embodiment of the invention only and not for purposes of limiting same, FIG. 1 shows a literature holder which is adapted to hold one or more elongated planar sheets of paper such as a pamphlet, a credit card application or the like. While the holder will be illustrated and hereinafter described as being employed to display and dispense such literature, it should be appreciated that the holder could also be employed in other types of merchandising displays so as to display and dispense other types of goods, for example, packets of powdered material such as drink mixes or soup mixes.

Figure 2:
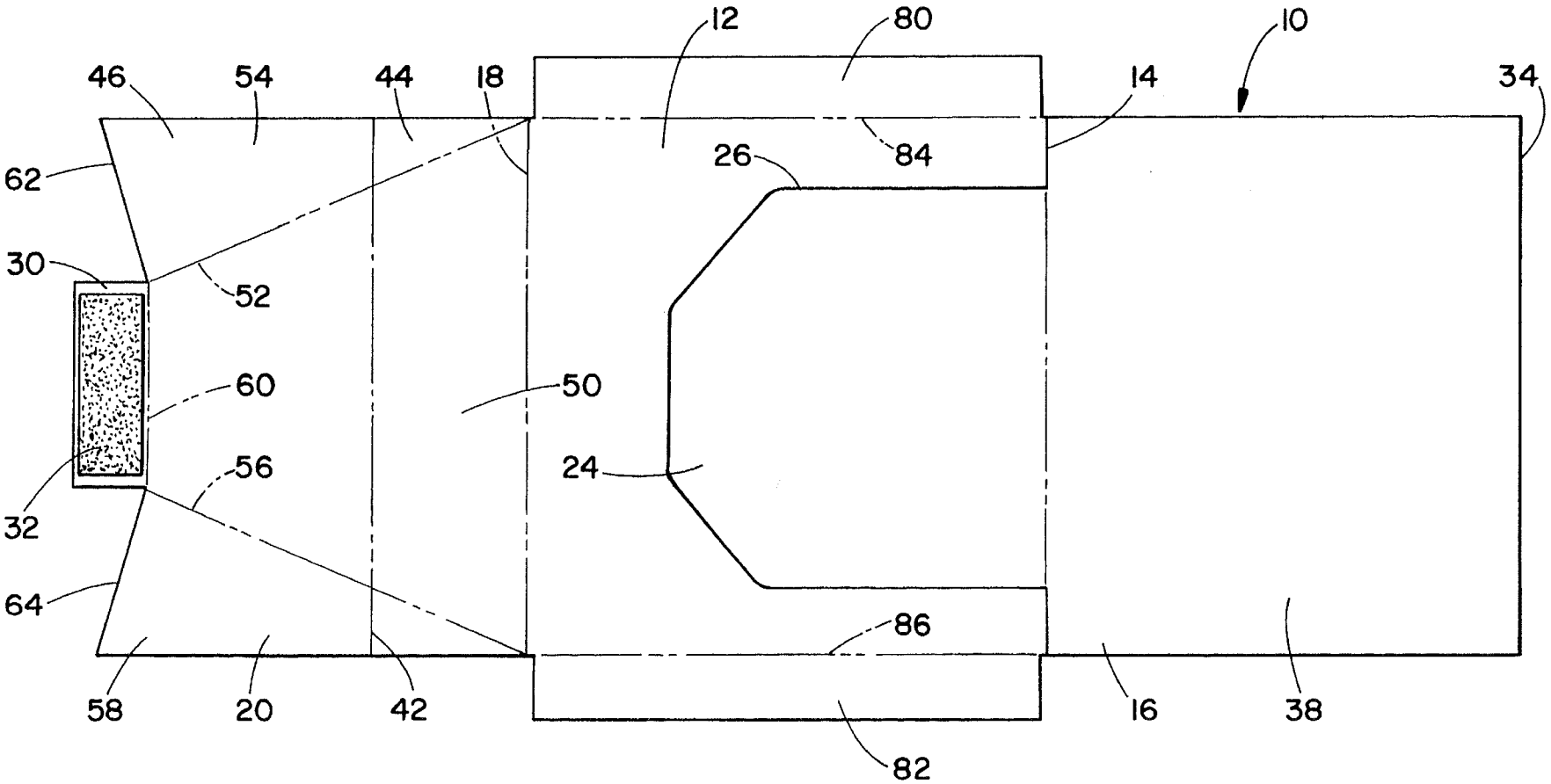
FIG. 2 is a developed view, on a reduced scale, of the holder of FIG. 1.

With reference now to FIG. 2, the holder of the present invention is comprised of a sheet 10 of a planar material, such as cardboard. The sheet 10 includes a front panel 12 delineated by a first score line 14 from a rear panel 16. The front panel is delineated by a second score line 18 from a bottom panel 20. It is evident that the first and second score lines 14 and 18 are substantially parallel to each other, are spaced from each other and each extend from one side edge of the sheet 10 to an opposing side edge.

Located in the front panel 12 is a flap 24. The flap is defined by means of a cut line 26. The flap 24 is substantially U-shaped such that the two ends of the cut line contact the first score line 14. In this way, the flap can be bent back out of the plane of the front panel 12 and towards the rear panel 16 as is evident from FIG. 1. It should be appreciated, however, that the flap does not need to be U-shaped and also does not need to have the two ends of the cut line contact the first score line. If desired, for example, the flap can be somewhat oval in shape and terminate in an additional score line (not illustrated) which may be parallel to but spaced from the first score line 14. In this connection, such additional score line can be located either on the front panel 12 or on the rear panel 16 as desired.

Figure 3:
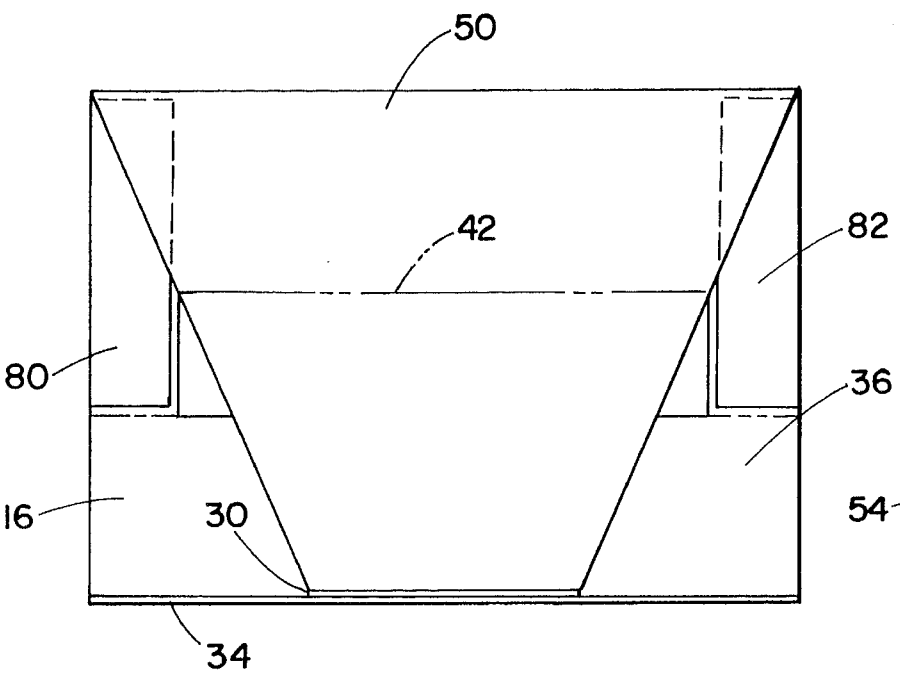
FIG. 3 is a bottom plan view of the holder of FIG. 1.

Extending away from the bottom panel 20 is a tab 30 which can be substantially rectangular in shape, if desired. Located on one side of the tab 30 is a layer of adhesive 32. The adhesive is used to secure the tab 30 to the rear panel 16. More specifically, the tab contacts the rear panel adjacent a free end 34 thereof. As is evident from FIG. 3, the tab 30 is positioned adjacent a back side 36 of the rear panel 16 and is adhered thereto by means of the adhesive 32. In the original unfolded condition of the sheet 10, therefore, the adhesive 32 is located on the same side of the sheet as is a front side 38 of the rear panel 16.

It should be appreciated that the tab, instead of being connected to the bottom panel, could be connected to the rear panel if that were considered desirable. It is only important that the tab extend from one of the rear panel and the bottom panel and cooperate with the other of the rear panel and the bottom panel to form the holder 10 into a triangular shape in which the holder is in a use configuration, as illustrated in FIG. 1. In addition, while adhesive is illustrated as the means for securing the tab to the rear panel, alternate means could be employed such as, e.g. a tab (which may have a different shape, such as, e.g. an arrow) being received in a slot (not illustrated) defined on, for example, the rear panel.

Figure 4:
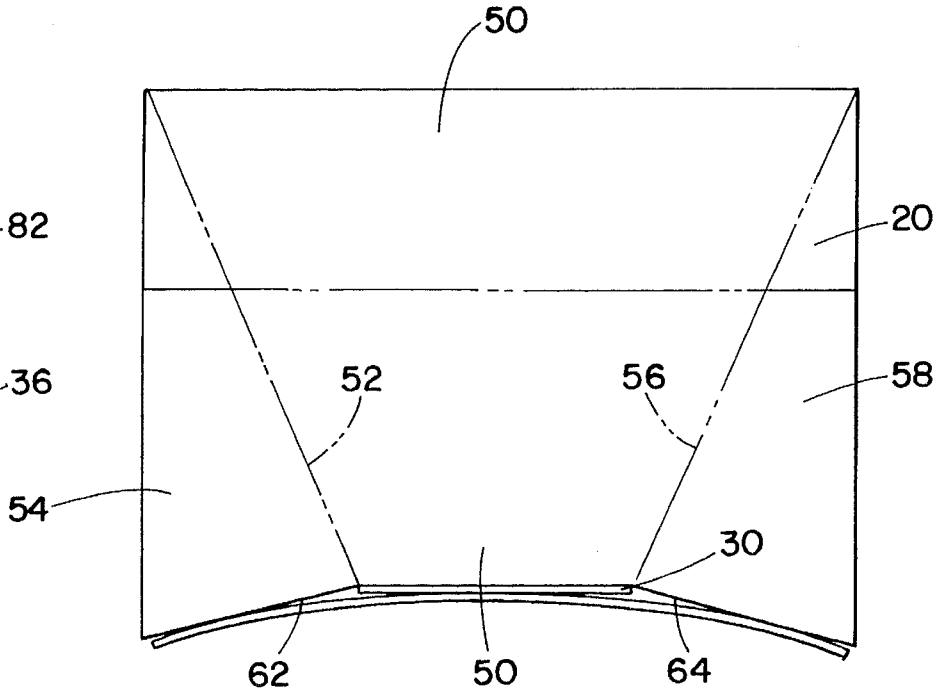
FIG. 4 is a bottom plan view of the holder, as in FIG. 3, but with the holder being disposed between its use configuration and a non-use configuration.

With reference again to FIG. 2, the bottom panel 20 has a third score line 42 extending transversely thereacross from one side edge thereof to the opposing side edge. The third score line 42 is substantially parallel to and spaced from the second score line 18 and divides the bottom panel into a first section 44 and a second section 46. With reference now also to FIG. 4, further defined in the bottom panel is a base 50 which is delineated in the bottom panel by a fourth score line 52, so as to form a first side brace 54, and by a fifth score line 56, so as to form a second side brace 58. The side braces can be bent up out of the plane of the base 50 so that the side braces are substantially perpendicular to the base. In this orientation, the side braces 54 and 58 abut the rear panel 16 as is evident from FIG. 1. Separating the tab 30 from the base 50 is a sixth score line 60. This score line is substantially parallel to and spaced from the third score line 42 but is considerably shorter in length.

As can perhaps be most clearly seen from FIG. 2, the substantially triangular first and second side braces 54 and 58 each have a respective free edge 62 and 64 which extends at an acute angle to the sixth score line 60. This construction enables the entire free edge of each side brace to abut against the back side 36 of the rear panel and maintain contact therewith when the side braces are folded up out of the plane of the base 50 and the holder is in its use configuration, as illustrated in FIG. 1. The side braces 54 and 58 provide a means for stablizing the holder in its use position in that the entire edges 62 and 64 contact the back side 36 of the rear panel 16. However, as shown in FIG. 4, this construction does not allow the side braces 54 and 58 to be folded out into the same plane as the base 50 without pushing the two side edges of the rear panel away from the plane of the adhesive contact made with the tab 30.

Figure 6:
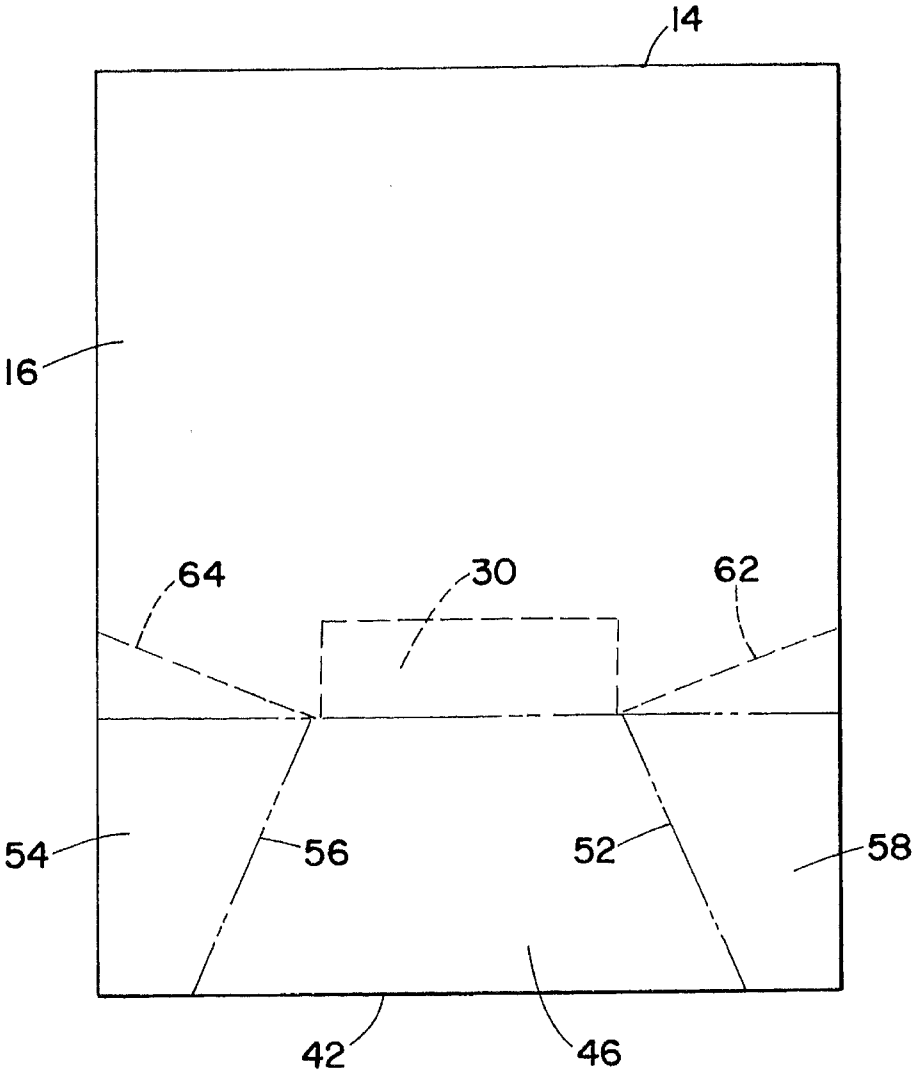
Figure 5:
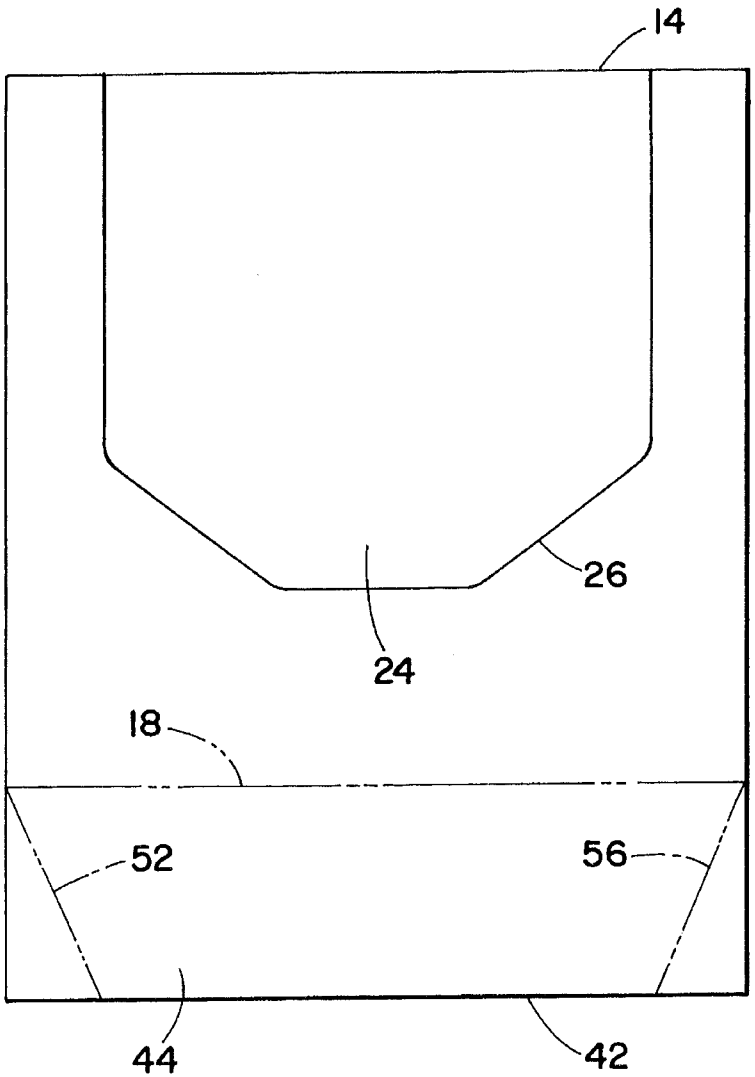
FIG. 5 is a front elevational view, on a reduced scale, of the holder of FIG. 1 in a flat non-use configuration; and, FIG. 6 is a rear elevational view, on a reduced scale, of the holder of FIG. 5 in a flat non-use configuration.

The holder configuration shown in FIG. 4 is, therefore, not very stable. Thus the holder is likely to snap into its non-use configuration in which it is folded along the third score line 42 and the first score line 14 as is illustrated in FIG. 6. When the holder is in its flat non-use configuration, a small triangular portion of each side brace 54 and 58 extends past the free end 34 of the rear panel.

As is evident from FIG. 1, when the flap 24 is folded out of the plane of the front panel 12 and back towards the rear panel 16, an opening 68 is formed. The opening can be used for holding planar sheet material, such as literature 70. Alternatively, the opening could be used to hold other types of goods for display and dispensing, such as packets of powdered material like drink mixes, soup mixes or the like.

It can be seen from FIG. 1 of the drawings that the flap 24 is provided with a pair of angled faces 72 and 74 in the areas of the flap where the flap, when it is bent out of the plane of the front panel, contacts the upper edges 76 and 78 of the side braces 54 and 58. As the flap 24 is pushed out of the plane of the front panel 12 and toward the rear panel 16, it pivots along the first hinge line 14 and eventually will contact the two side braces.

The flap 24 cooperates with the two side braces 54 and 58 to urge the bottom ends of the literature 70 held in the holder forward, i.e., towards the front panel 12 of the holder and away from the rear panel 16 thereof. This insures that the literature will tip backward so that the mid-section of the literature rests against the top of the rear face 16. If the literature 70 were tipped the other way, such that its bottom end were to abut the rear panel 16, then the top end of the literature would be angled forward and the midsection of the literature would not rest against the top end of the back face. Such a forward tipping of the literature is disadvantageous as the literature would then be difficult to read. Such orientation of the literature may also tip the holder itself over, which would be unacceptable.

With reference again to FIG. 2, if desired the first panel 12 can be provided with edge stiffening means. More particularly, a pair of wings 80 and 82 are provided which are delineated by respective fold lines 84 and 86 from the front panel 12. The wings 80 and 82 are meant to be folded back onto the front panel to reinforce the side edges of same, as is illustrated in FIG. 1. The wings can be secured to a back face of the front panel by means of a suitable adhesive 88 which can, if desired, be coated on the wings after the sheet is manufactured. As is evident from FIG. 3, the wings can, if desired, each extend substantially the entire length of the front face 12. The wings each have a respective free edge which terminates short of the cut line 26 defining the flap 24 in the front panel 12 so that the flap can easily be pushed out of the front panel.

Because the sheet 10 is preferably manufactured of a conventional cardboard material by die-cutting or the like, it is inexpensive to produce and is readily recyclable. In addition, such cardboard material can be readily printed on as may be advantageous to enhance the display and dispensing of the goods held by the holder. It should be appreciated, however, that the sheet 10 could also be manufactured out of a thermoplastic material if that were considered necessary or advantageous.

The invention has been described with reference to a preferred embodiment. It should be appreciated, however, that alterations and modifications will occur to those of average skill in the art upon the reading and understanding of this specification. It is intended to include all such modifications and alterations as come within the scope of the attached claims or the equivalents thereof.

Having thus described the present invention, it is now claimed:

We claim:

1. A holder for goods comprising:

an elongated sheet having first and second transverse score lines, the sheet being bent along said first score line to form a front panel and a back panel, extending in a first direction from said front panel, and bent along said second score line to form a bottom panel, extending in a second direction from said front panel;

a substantially U-shaped flap formed in said front panel such that the two ends of the U contact said first score line;

a tab extending from said bottom panel; and, a layer of adhesive provided on said tab, wherein when said adhesive layer is contacted with said back panel to secure said tab to said back panel, said sheet can be formed into a triangular shape in which the holder is in a use configuration.

2. The holder of claim 1 further comprising a third score line extending transversely across said bottom panel parallel to said second score line and spaced therefrom, wherein said bottom panel can be folded along said third score line into first and second sections in order to collapse the holder into a flat non-use configuration.

3. The holder of claim 2 further comprising a fourth score line located in said bottom panel and extending at an acute angle to a first side edge of said bottom panel from said first side edge of said bottom panel to said tab, such that a first end of said fourth score line intersects said second score line adjacent its first end and a second end of said fourth score line terminates adjacent a first side of said tab.

4. The holder of claim 3 further comprising a fifth score line located in said bottom panel and extending at an acute angle to a second side edge of said bottom panel from said second side edge of said bottom panel to said tab, such that a first end of said fifth score line intersects said second score line adjacent its second end and a second end of said fifth score line terminates adjacent a second side of said tab.

5. The holder of claim 3 wherein said bottom panel can be folded along said fourth score line to form a first side brace for the holder when the holder is in its use configuration.

6. The holder of claim 4 wherein said bottom panel can be folded along said fifth score line to form a second side brace for the holder when the holder is in its use configuration.

7. The holder of claim 4 wherein said fourth and fifth score lines intersect said third score line.

8. The holder of claim 1 comprising a sixth score line which separates said tab from said bottom panel.

9. The holder of claim 1 wherein said flap can be folded out of a plane of said front panel and towards said back panel to allow goods to be inserted into the holder for display and dispensing.

10. The holder of claim 1 further comprising a wing extending from said front panel and a seventh score line separating said wing from said front panel, wherein said wing can be folded around said seventh score line to lie against said front panel and stiffen same.

11. The holder of claim 10 further comprising a pair of wings located on opposed side edges of said front panel, wherein said wings can be folded in relation to said front panel so as to lie against a rear face thereof in order to reinforce said front panel.

12. A holder for goods comprising:

an elongated sheet having first and second transverse score lines, the sheet being bent along said first score line to form a front panel and a back panel, extending in a first direction from said front panel, and bent along said second score line to form a bottom panel, extending in a second direction from said front panel;

a substantially U-shaped flap formed in said front panel such that the two ends of the U contact said first score line;

a tab extending from one of said back panel and said bottom panel and cooperating with the other of said back panel and said bottom panel to form the holder into a triangular shape in which the holder is in a use configuration; and, first and second side braces formed in said bottom panel and delineated respectively along third and fourth score lines, said side braces supporting the holder in its use configuration.

13. The holder of claim 12 further comprising a fifth score line extending transversely across said bottom panel parallel to said second score line and spaced therefrom, wherein said bottom panel can be folded along said third score line into first and second sections in order to collapse the holder into a flat non-use configuration.

14. The holder of claim 12 wherein said flap can be folded out of a plane of said front panel and towards said back panel to allow goods to be inserted in the holder for display and dispensing.

15. The holder of claim 12 wherein said side braces each have an edge which contacts a respective side of said back panel when said side braces are folded out of said bottom panel.

16. A holder for goods comprising:

an elongated sheet having first and second transverse score lines, the sheet being bent along said first score line to form a front panel and a back panel, extending in a first direction from said front panel, and bent along said second score line to form a bottom panel, extending in a second direction from said front panel;

a flap formed in said front panel for accommodating goods held in the holder when said flap is bent out of a plane of said front panel;

a tab extending from one of said back panel and said bottom panel and cooperating with the other of said back panel and said bottom panel to form the holder into a triangular shape in which the holder is in a use configuration; and, first and second side braces formed in said bottom panel and delineated respectively along third and fourth score lines, said side braces supporting the holder in its use configuration.

17. The holder of claim 16 further comprising a layer of adhesive provided on said tab, wherein when said adhesive layer is contacted with said other of said back panel and said bottom panel to secure said tab to said back panel, said sheet can be formed into a triangular shape.

18. The holder of claim 16 further comprising a fifth score line extending transversely across said bottom panel parallel to said second score line and spaced therefrom, wherein said bottom panel can be folded along said third score line into first and second sections in order to allow the holder to be collapsed into a flat non-use configuration.

19. The holder of claim 16 wherein said fifth score line intersects said third and fourth score lines.

20. The holder of claim 16 wherein said side braces each have an edge which contacts a respective side of said back panel when said side braces are folded out of said bottom panel.

21. The holder of claim 16 further comprising edge stiffening means for stiffening opposed edges of said front panel.

22. The holder of claim 21 herein said edge stiffening means comprises a pair of wings located on opposed side edges of said front panel.

* * * * *